US009797401B2

(12) United States Patent
Tatsuwaki et al.

(10) Patent No.: US 9,797,401 B2
(45) Date of Patent: Oct. 24, 2017

(54) SCROLL COMPRESSOR

(71) Applicant: Mitsubishi Electric Corporation, Tokyo (JP)

(72) Inventors: Kohei Tatsuwaki, Tokyo (JP); Fumihiko Ishizono, Tokyo (JP); Masayuki Kakuda, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 38 days.

(21) Appl. No.: 15/026,996

(22) PCT Filed: Dec. 9, 2013

(86) PCT No.: PCT/JP2013/082908
§ 371 (c)(1),
(2) Date: Apr. 4, 2016

(87) PCT Pub. No.: WO2015/087374
PCT Pub. Date: Jun. 18, 2015

(65) Prior Publication Data

US 2016/0230764 A1 Aug. 11, 2016

(51) Int. Cl.
*F04C 29/00* (2006.01)
*F01C 17/06* (2006.01)
(Continued)

(52) U.S. Cl.
CPC ..... *F04C 29/0057* (2013.01); *F01C 17/066* (2013.01); *F04C 18/0215* (2013.01);
(Continued)

(58) Field of Classification Search
CPC ..... F01C 17/066; F04C 18/0215; F04C 18/0253; F04C 23/008; F04C 29/0021;
(Continued)

(56) References Cited

U.S. PATENT DOCUMENTS 6,109,898 A * 8/2000 Scarlett ..... F01C 17/06 29/434
6,139,293 A * 10/2000 Iizuka ..... F01C 17/063 418/55.3
(Continued)

FOREIGN PATENT DOCUMENTS

JP 58-28433 B2 6/1983
JP 59-108889 A 6/1984
(Continued)

OTHER PUBLICATIONS

Extended European Search Report dated May 4, 2017 issued in corresponding EP application No. 13899267.2.
(Continued)

*Primary Examiner* — Mark Laurenzi
*Assistant Examiner* — Dapinder Singh
(74) *Attorney, Agent, or Firm* — Posz Law Group, PLC

(57) ABSTRACT

A scroll compressor includes a stationary scroll; an orbiting scroll having a pair of first Oldham keyways on one surface thereof, the orbiting scroll defining a compression chamber in combination with the stationary scroll; a frame having a pair of second Oldham keyways and supporting the orbiting scroll; and an Oldham ring for inhibiting rotation of the orbiting scroll, the Oldham ring having a pair of first Oldham keys on one surface thereof and a pair of second Oldham keys on the other surface thereof, the first Oldham keys slidably engaging with the respective first Oldham keyways, the second Oldham keys slidably engaging with the respective second Oldham keyways. The Oldham ring includes at least a pair of projections on the other surface thereof, and the projections have a height such that when the Oldham ring is inclined during simple harmonic motion, one of the projections makes contact with the one surface of the orbiting scroll before each of the first Oldham keys is brought into contact with the corresponding first Oldham keyway at two locations.

9 Claims, 7 Drawing Sheets

(51) Int. Cl.

| | |
|---|---|
| ***F04C 18/02*** | (2006.01) |
| ***F04C 23/00*** | (2006.01) |
| ***F25B 1/04*** | (2006.01) |
| ***F25B 47/02*** | (2006.01) |
| ***F25B 49/02*** | (2006.01) |
| *F04C 29/02* | (2006.01) |

(52) U.S. Cl.
CPC ..... *F04C 18/0253* (2013.01); *F04C 23/008* (2013.01); *F04C 29/0021* (2013.01); *F04C 29/0085* (2013.01); *F25B 1/04* (2013.01); *F25B 47/022* (2013.01); *F25B 49/025* (2013.01); *F25B 49/027* (2013.01); *F04C 29/025* (2013.01); *F04C 2240/50* (2013.01); *F04C 2240/807* (2013.01)

(58) Field of Classification Search
CPC ..... F04C 29/0057; F04C 29/0085; F04C 2240/50; F04C 2240/807; F25B 1/04; F25B 47/022; F25B 49/025; F25B 49/027
USPC ..... 418/55.1–55.6
See application file for complete search history.

(56) References Cited

U.S. PATENT DOCUMENTS

| | | | | |
|---|---|---|---|---|
| 6,158,991 | A * | 12/2000 | Ohtake | F04C 27/005 418/55.3 |
| 6,200,115 | B1 * | 3/2001 | Kikuchi | F01C 17/06 418/55.3 |
| 6,537,045 | B2 * | 3/2003 | Riegger | F01C 21/02 184/6.16 |
| 6,666,669 | B2 * | 12/2003 | Suss | F01C 17/066 418/55.3 |
| 7,214,043 | B2 * | 5/2007 | Tsukamoto | F01C 17/04 418/55.3 |
| 7,914,268 | B2 * | 3/2011 | Su | F01C 21/10 29/888.022 |
| 9,605,677 | B2 * | 3/2017 | Heidecker | F04C 29/02 |
| 2009/0317276 | A1 * | 12/2009 | Lee | F04C 18/0215 418/55.3 |

FOREIGN PATENT DOCUMENTS

| | | | |
|---|---|---|---|
| JP | 62-119529 | U | 7/1987 |
| JP | 62-147072 | A | 7/1987 |
| JP | 05-044659 | A | 2/1993 |
| JP | 06-042473 | A | 2/1994 |
| JP | 10-026088 | A | 1/1998 |
| JP | H10-026088 | A | 1/1998 |
| JP | H10-082382 | A | 3/1998 |
| JP | H10-122164 | A | 5/1998 |
| JP | H11-287101 | A | 10/1999 |
| JP | 2001-140776 | A | 5/2001 |
| JP | 2003-148362 | A | 5/2003 |
| JP | 2004-308591 | A | 11/2004 |
| JP | 2010-043567 | A | 2/2010 |

OTHER PUBLICATIONS

International Search Report of the International Searching Authority dated Jan. 28, 2014 for the corresponding International application No. PCT/JP2013/082908 (and English translation).

* cited by examiner

SCROLL COMPRESSOR

CROSS REFERENCE TO RELATED APPLICATIONS

This application is a U.S. national stage application of International Application No. PCT/JP2013/082908 filed on Dec. 9, 2013, the disclosure of which is incorporated herein by reference.

TECHNICAL FIELD

The present invention relates to a scroll compressor of, for example, an air-conditioning apparatus or a refrigerating apparatus.

BACKGROUND ART

An example of a conventional scroll compressor includes an orbiting scroll having a scroll wrap formed on a surface of a base plate, a frame that axially supports the orbiting scroll, a pair of Oldham keyways formed in the orbiting scroll, a pair of Oldham keyways formed in the frame in the direction perpendicular to the keyways of the orbiting scroll, and an Oldham ring placed between the orbiting scroll and the frame (see, for example, Patent Literature 1).

A pair of Oldham keys that slidably engage with the Oldham keyways of the orbiting scroll or frame and projections (protrusions) are formed on both surfaces of this Oldham ring. During operation of the scroll compressor, the orbiting scroll and the frame slide on the Oldham ring. The projections (protrusions) enable the contact area thereof, and hence friction due to the sliding, to be reduced.

CITATION LIST

Patent Literature

Patent Literature 1: Japanese Unexamined Patent Application Publication No. 2001-140776 (see, for example, FIG. 1)

SUMMARY OF INVENTION

Technical Problem

When the scroll compressor is operated at a high speed, the Oldham ring is inclined due to its increased inertial force. The projections disclosed in Patent Literature 1, however, do not have sufficient height to prevent each Oldham key from making contact with the interior of the corresponding Oldham keyway at two locations. The adhesive wear of the Oldham keys thereby occurs in the Oldham keyways, resulting in galling.

The present invention addresses the above problem, and an object of the present invention is to provide a scroll compressor that can prevent the occurrence of the adhesive wear of the Oldham key in the interior of the Oldham keyway.

Solution to Problem

A scroll compressor according to the present invention includes a stationary scroll; an orbiting scroll having a pair of first Oldham keyways on one surface thereof, the orbiting scroll defining a compression chamber in combination with the stationary scroll; a frame having a pair of second Oldham keyways and supporting the orbiting scroll; and an Oldham ring for inhibiting rotation of the orbiting scroll, the Oldham ring having a pair of first Oldham keys on one surface thereof and a pair of second Oldham keys on an other surface thereof, the first Oldham keys slidably engaging with the respective first Oldham keyways, the second Oldham keys slidably engaging with the respective second Oldham keyways. The Oldham ring includes at least a pair of projections on the other surface thereof, and the projections have a height such that when the Oldham ring is inclined during simple harmonic motion, one of the projections makes contact with the one surface of the orbiting scroll before each of the first Oldham keys is brought into contact with the corresponding first Oldham keyway at two locations.

Advantageous Effects of Invention

A scroll compressor according to the present invention allows, before each Oldham key is brought into contact with the interior of the corresponding Oldham keyway at two locations, one of the projections to make contact with one surface of the orbiting scroll and can thus prevent each Oldham key from making contact with the interior of the corresponding Oldham keyway at two locations and prevent the adhesive wear from occurring.

DESCRIPTION OF EMBODIMENTS

An embodiment of the present invention will be described hereinafter with reference to the drawings. The present invention, however, is not limited to the embodiment described below. The dimensional relations of components shown in the accompanying drawings may differ from the actual relations.

Embodiment

Figure 1:
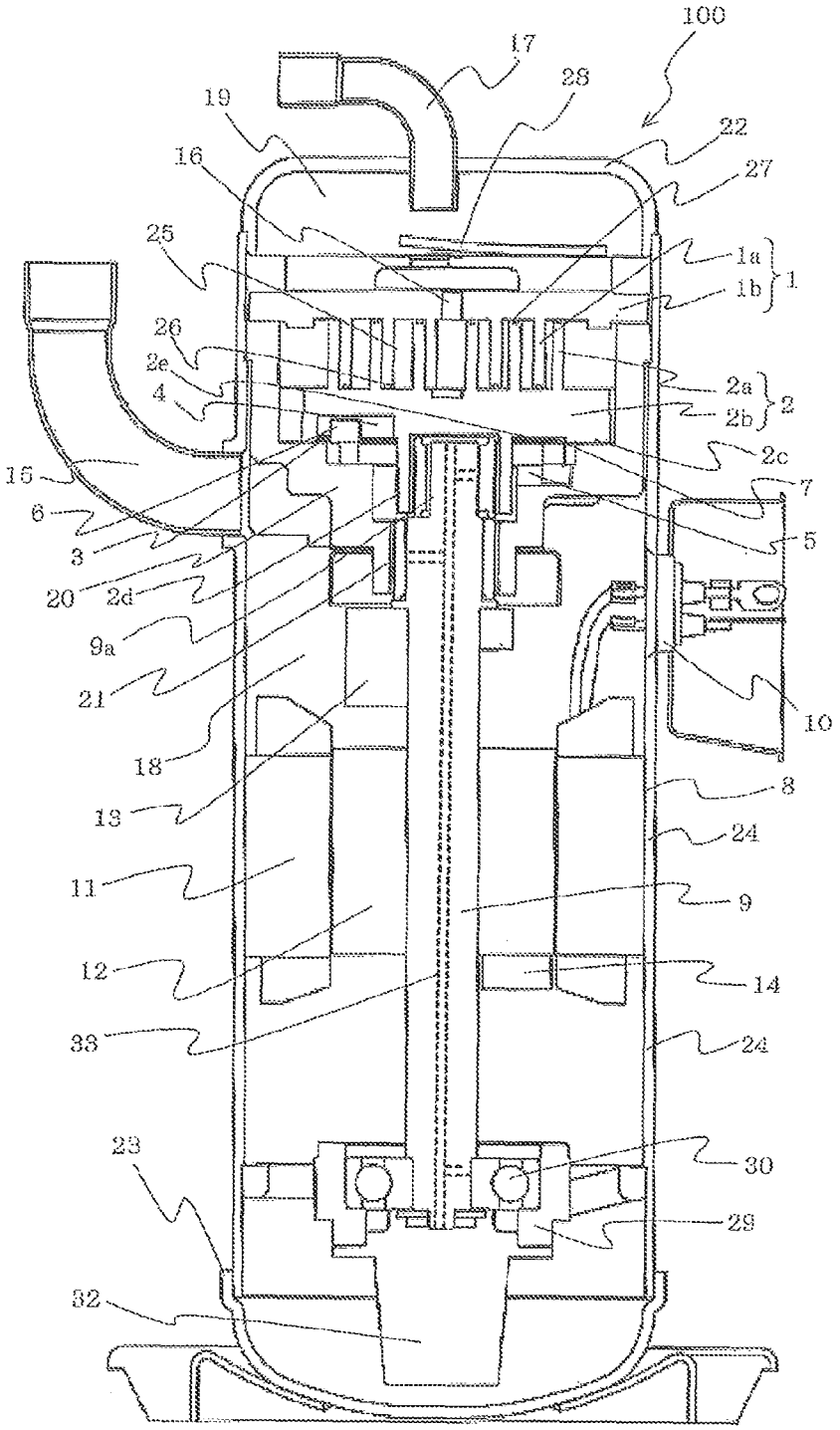
FIG. 1 is a longitudinal sectional view of an exemplary sectional configuration of a scroll compressor according to Embodiment of the present invention.
Figure 2:
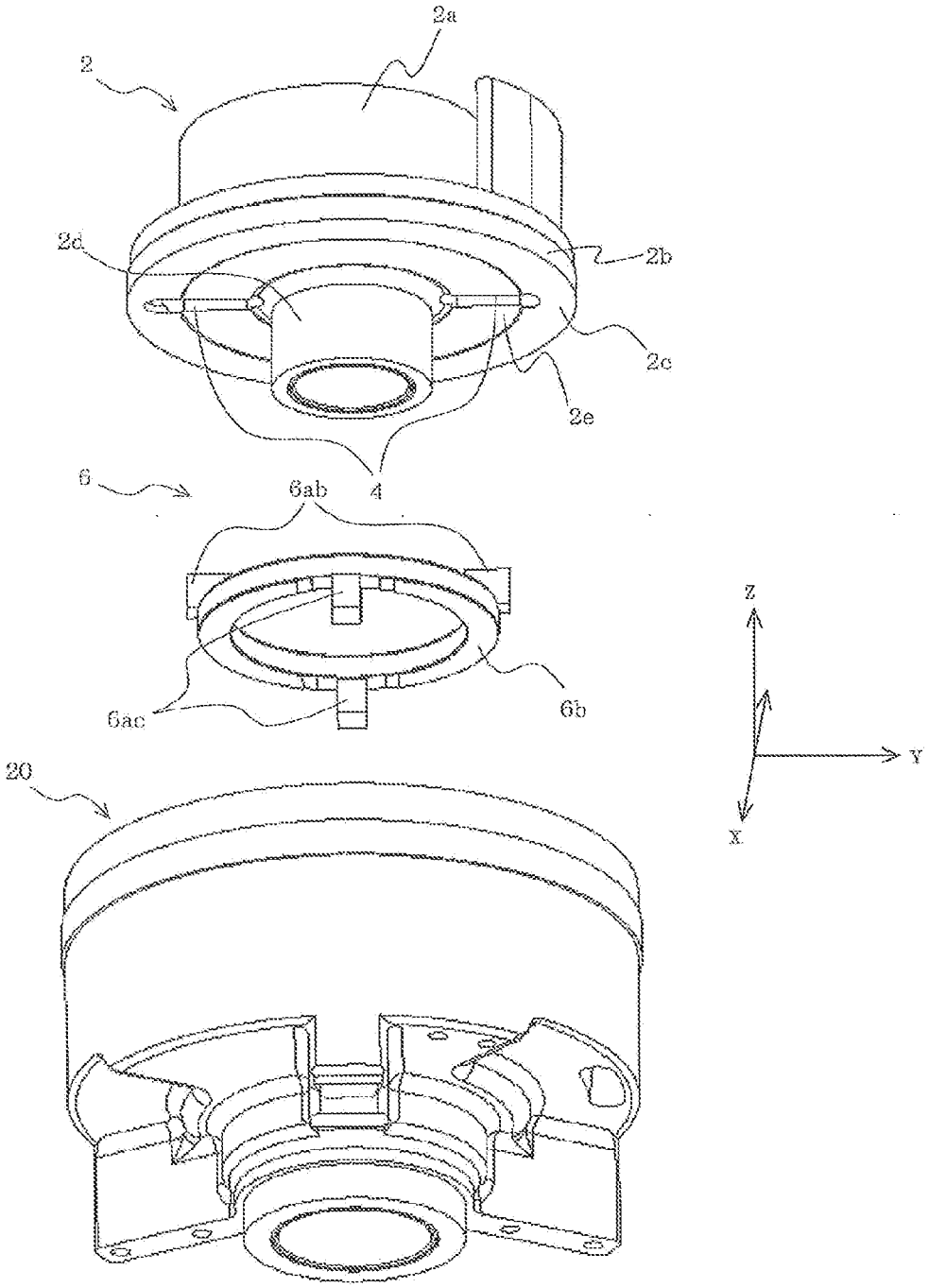
FIG. 2 is an exploded view of an orbiting scroll, an Oldham ring, and a frame according to Embodiment of the present invention (viewed in the X-axis direction).
Figure 3:
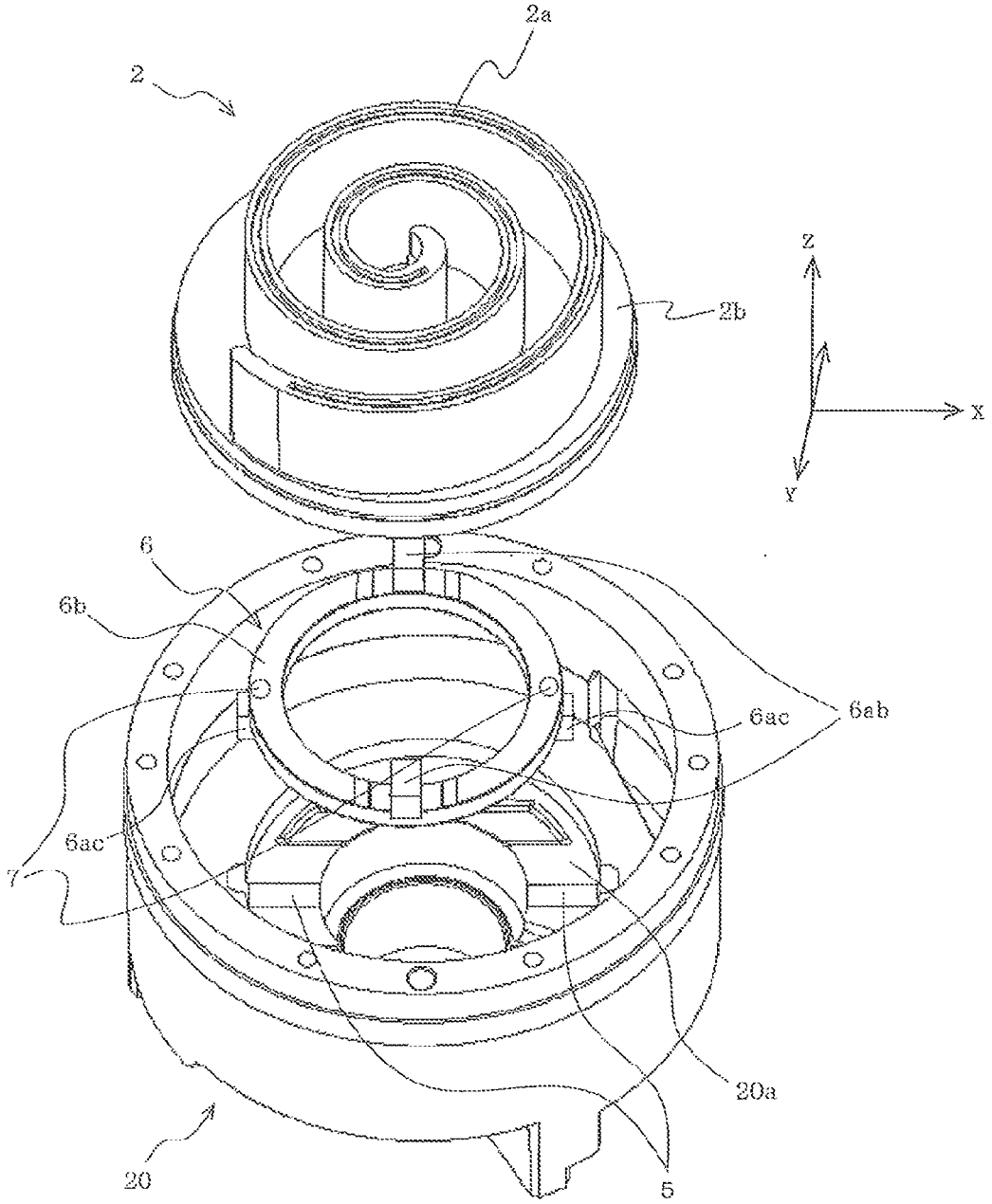
FIG. 3 is an exploded view of the orbiting scroll, the Oldham ring, and the frame according to Embodiment of the present invention (viewed in the Y-axis direction).

FIG. 1 is a longitudinal sectional view of an exemplary sectional configuration of a scroll compressor 100 according to Embodiment of the present invention. FIG. 2 is an exploded view of an orbiting scroll 2, an Oldham ring 6, and a frame 20 according to Embodiment of the present invention (viewed in the X-axis direction). FIG. 3 is an exploded view of the orbiting scroll 2, the Oldham ring 6, and the frame 20 according to Embodiment of the present invention (viewed in the Y-axis direction).

The configuration and operation of the scroll compressor 100 will now be described with reference to FIGS. 1 to 3.

The scroll compressor 100 according to Embodiment may be a component of a refrigeration cycle for use in various forms of industrial machinery such as a refrigerator, freezer, vending machine, air-conditioning apparatus, refrigerating apparatus, and hot-water heater.

The scroll compressor 100 sucks in and compresses the refrigerant circulating through the refrigeration cycle and discharges refrigerant at a high temperature and pressure. As shown in FIG. 1, this scroll compressor 100 includes a compression mechanism in which a stationary scroll 1 and an orbiting scroll 2 that orbits with respect to the stationary scroll 1 are combined, inside a sealed container 24 including a center shell 8, an upper shell 22, and a lower shell 23. A rotational driving unit including a main shaft 9, a stator 11, a rotor 12, and other components is provided inside the sealed container 24. In the sealed container 24, the compression mechanism is arranged on the upper side and the rotational driving unit is arranged on the lower side.

The sealed container 24 is configured such that the upper shell 22 is disposed at an upper portion of the center shell 8 and the lower shell 23 is disposed at a lower portion of the center shell 8. The lower shell 23 serves as an oil sump for storing lubricant. A suction pipe 15 through which refrigerant gas is sucked is connected to the center shell 8. A discharge pipe 17 through which the refrigerant gas is discharged is connected to the upper shell 22. The interior of the center shell 8 is a low-pressure chamber 18. The interior of the upper shell 22 is a high-pressure chamber 19.

The stationary scroll 1 includes a stationary-scroll base plate 1*b* and a stationary-scroll wrap la that is a scroll lap extending from one surface (lower side in FIG. 1) of the stationary-scroll base plate 1*b*. The orbiting scroll 2 includes an orbiting-scroll base plate 2*b* and an orbiting-scroll wrap 2*a* that is a scroll lap having substantially the same dimension as the stationary-scroll wrap 1*a* and extending from one surface (upper side in FIG. 1) of the orbiting-scroll base plate 2*b*. The other surface of the orbiting-scroll base plate 2*b* (surface on the lower side opposite the surface on which the orbiting-scroll wrap 2*a* is formed in FIG. 1) acts as an orbiting-scroll thrust bearing surface 2*c*.

The stationary scroll 1 is to the frame 20 with, for example, a bolt (not shown).

The orbiting scroll 2 is configured such that a thrust bearing load generated during operation of the scroll compressor is supported by the frame 20 through the orbiting-scroll thrust bearing surface 2*c*. When the frame 20 does not have sufficient hardness to support the thrust bearing load, as shown in FIG. 1, a thrust plate 3 made of a material having sufficient hardness to support the thrust bearing load may be interposed between the orbiting-scroll thrust bearing surface 2*c* and the frame 20.

The stationary scroll 1 and the orbiting scroll 2 are installed inside the sealed container 24 with the stationary-scroll wrap 1*a* meshing with the orbiting-scroll wrap 2*a*. When the stationary scroll 1 and the orbiting scroll 2 are thus combined, the scroll direction of the stationary-scroll wrap 1*a* is opposite to the scroll direction of the orbiting-scroll wrap 2*a*. A compression chamber 25 having a comparatively variable volume is defined between the stationary-scroll wrap 1*a* and orbiting-scroll wrap 2*a*. To suppress refrigerant from leaking from the end face of the stationary-scroll wrap 1*a* and orbiting-scroll wrap 2*a*, the stationary scroll 1 and the orbiting scroll 2 are provided with a seal 26 on the end face of the stationary-scroll wrap 1*a* and a seal 27 on the end face of the orbiting-scroll wrap 2*a*, respectively.

A discharge outlet 16 through which compressed high-pressure refrigerant gas is discharged is formed at a central portion of the stationary-scroll base plate 1*b* of the stationary scroll 1. This compressed high-pressure refrigerant gas is exhausted to the high-pressure chamber 19 provided above the stationary scroll 1. The refrigerant gas exhausted to the high-pressure chamber 19 is discharged into the refrigeration cycle through the discharge pipe 17. The discharge outlet 16 is provided with a discharge valve 28 that prevents backflow of the refrigerant from the high-pressure chamber 19 toward the discharge outlet 16.

The Oldham ring 6 impedes rotational motion of the orbiting scroll 2 and permits orbital motion of the orbiting scroll 2 so that the orbiting scroll 2 orbits with respect to the stationary scroll 1 without rotating. A hollow cylindrical boss 2*d* is formed at a substantially central portion on the surface of the orbiting scroll 2 opposite the surface on which the orbiting-scroll wrap 2*a* is formed. An eccentric shaft 9*a* provided at the upper end of the main shaft 9 is inserted into the hollow of the boss 2*d*. An orbiting-scroll-base-plate back surface 2*e* is formed between the boss 2*d* and the orbiting-scroll thrust bearing surface 2*c* on the same surface.

As shown in FIGS. 2 and 3, a pair of front and rear (Y-axis direction) first Oldham keyways 4 and a pair of left and right (X-axis direction) second Oldham keyways 5 are formed on the surface of the orbiting scroll 2 opposite the surface on which the orbiting-scroll wrap 2*a* is formed and an Oldham-ring seating surface 20*a* of the frame 20 on which the Oldham ring 6 is placed, respectively. The Oldham ring 6 is interposed between the orbiting scroll 2 having the first Oldham keyways 4 and the frame 20 having the second Oldham keyways 5.

Quadrangular prism-shaped second Oldham keys 6*ac* that slidably engage with the respective second Oldham keyways 5 of the frame 20 and quadrangular prism-shaped first Oldham keys 6*ab* that slidably engage with the respective first Oldham keyways 4 of the orbiting scroll 2 are formed on the lower surface (lower side in FIG. 2) and the upper surface (upper side in FIG. 2) of a ring base 6*b* of the Oldham ring 6, respectively. The pair of front and rear (Y-axis direction) first Oldham keys 6*ab* and the pair of left and right (X-axis direction) second Oldham keys 6*ac* slidably engage with the pair of front and rear (Y-axis direction) first Oldham keyways 4 of the orbiting scroll 2 and the pair of left and right (X-axis direction) second Oldham keyways 5 of the frame 20, respectively.

The first Oldham keys 6*ab* and second Oldham keys 6*ac* transmit turning force of the rotational driving unit to the orbiting scroll 2 for orbital motion while sliding in the front-and-rear direction (Y-axis direction) or the left-and-right direction (X-axis direction) on sliding surfaces formed in the front and rear (Y-axis direction) first Oldham keyways 4 and left and right (X-axis direction) second Oldham keyways 5 that are filled with lubricant. During this operation, the Oldham ring 6 undergoes simple harmonic motion in the left-and-right direction (X-axis direction) with respect to the frame 20 and the orbiting scroll 2 undergoes simple harmonic motion in the front-and-rear direction (Y-axis direction) with respect to the Oldham ring 6.

As shown in FIG. 1 the rotational driving unit includes the main shaft 9 that is a rotating shaft, the rotor 12 fixed to the main shaft 9, the stator 11 fixed to the center shell 8, and other components. The rotor 12 is shrink-fitted to the main shaft 9. Energizing the stator 11 causes rotation of the rotor 12 to begin, thereby rotating the main shaft 9. That is, the stator 11 and rotor 12 serve as an electric rotary machine. The rotor 12 is disposed below a first balance weight 13 fixed to the main shaft 9, together with the stator 11 shrink-fitted to the center shell 8. The stator 11 is supplied with electric power through a power terminal 10 provided on the center shell 8.

The main shaft 9 rotates with the rotation of the rotor 12 and causes the orbiting scroll 2 to orbit. An upper portion of the main shaft 9 (portion near the eccentric shaft 9*a*) is supported by a main bearing 21 provided on the frame 20. A lower portion of the main shaft 9 is rotatably supported by a sub bearing 30. The sub bearing 30 is press-fitted into a bearing receiving portion formed at a central portion of a sub frame 29 provided at a lower portion of the sealed container 24. The sub frame 29 is provided with a displacement-type oil pump 32. The oil pump 32 sucks in lubricant and supplies the lubricant to sliding portions through an oil supplying passage 33 formed in the interior of the main shaft 9.

The first balance weight 13 is provided at an upper portion of the main shaft 9 to compensate for an imbalance that occurs when the orbital motion is imparted to the orbiting scroll 2 joined to the eccentric shaft 9*a*, A second balance weight 14 is provided at a lower portion of the rotor 12 to compensate for the imbalance that occurs when the orbital motion is imparted to the orbiting scroll 2 joined to the eccentric shaft 9*a*. The first balance weight 13 is shrink-fitted to the upper portion of the main shaft 9. The second balance weight 14 is integrally fixed to the lower portion of the rotor 12.

Projections 7 of the Oldham ring 6 will be described later.

The operation of the scroll compressor 100 will now be described.

When the power terminal 10 is energized, an electric current flows through an electric wire of the stator 11, generating a magnetic field. This magnetic field rotates the rotor 12. In other words, torque is generated between the stator 11 and the rotor 12, and the rotor 12 rotates. The rotation of the rotor 12 causes the main shaft 9 to rotate. The rotation of the main shaft 9 causes the orbiting scroll 2, which is inhibited from rotating by the Oldham ring 6, to orbit.

The first balance weight 13 fixed to the upper portion of the main shaft 9 and the second balance weight 14 fixed to the lower portion of the rotor 12 statically and dynamically balance the eccentric orbital motion of the orbiting scroll 2 while the rotor 12 rotates. This allows the orbiting scroll 2, which is eccentrically supported at the upper portion of the main shaft 9 and inhibited from rotating by the Oldham ring 6, to orbit. When the orbital motion is started, refrigerant is compressed according to a known compression principle.

Part of the refrigerant gas flows into the compression chamber 25 through a frame refrigerant suction inlet of the frame 20. Thus, a suction process is started. The remaining part of the refrigerant gas passes through a cutout (not shown) of a steel sheet of the stator 11 and cools the electric rotary machine and the lubricant. The orbital motion of the orbiting scroll 2 moves the compression chamber 25 toward the center of the orbiting scroll 2 and reduces the volume of the compression chamber 25. The process compresses the refrigerant gas sucked into the compression chamber 25. The compressed refrigerant passes through the discharge outlet 16 of the stationary scroll 1, opens the discharge valve 28, and flows into the high-pressure chamber 19. The refrigerant is then discharged from the sealed container 24 through the discharge pipe 17.

The frame 20 supporting the orbiting-scroll thrust bearing surface 2*c* carries the thrust bearing load generated by the pressure of the refrigerant gas in the compression chamber 25. The main bearing 21 and the sub bearing 30 carry the load of the refrigerant gas and the centrifugal force of the first and second balance weights 13 and 14 due to the rotation of the main shaft 9. The stationary scroll 1 and frame 20 are airtight, separating a low-pressure refrigerant gas in the low-pressure chamber 18 and a high-pressure refrigerant gas in the high-pressure chamber 19. When the energization of the stator 11 is stopped, the operation of the scroll compressor 100 is terminated.

Figure 4A:
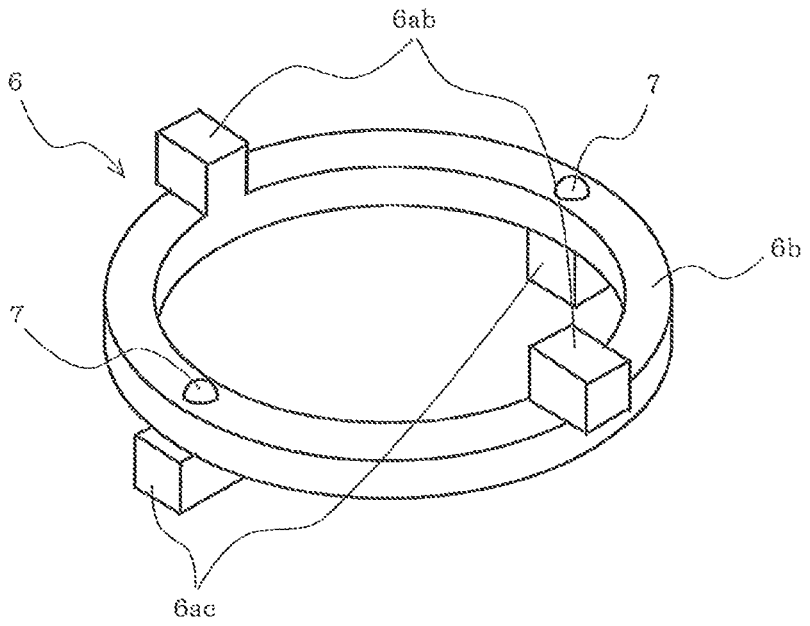
FIG. 4*a* is a perspective view of the Oldham ring of the scroll compressor according to Embodiment of the present invention.
Figure 4B:
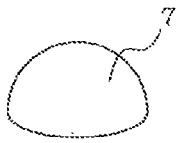
FIG. 4*b* is an enlarged view of a projection formed on the Oldham ring of the scroll compressor according to Embodiment of the present invention.
Figure 5A:
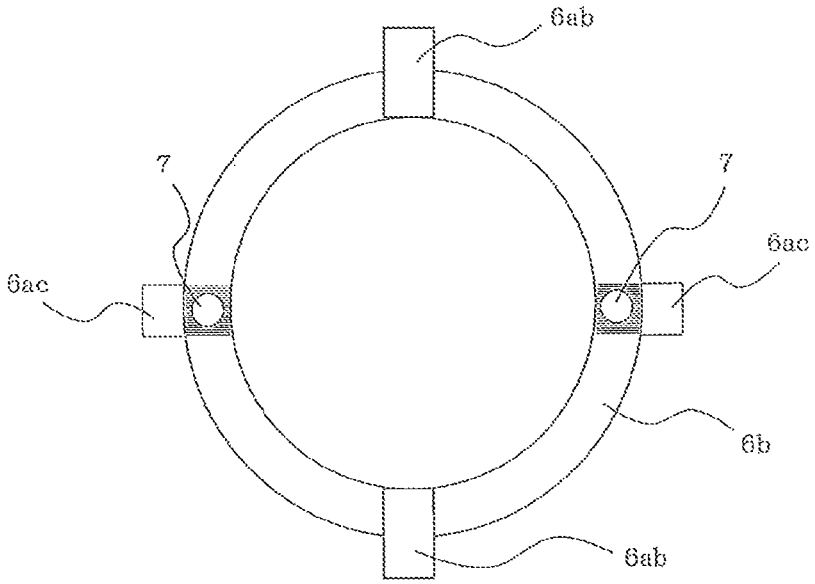
FIG. 5*a* is a top view of the Oldham ring of the scroll compressor according to Embodiment of the present invention.
Figure 5B:
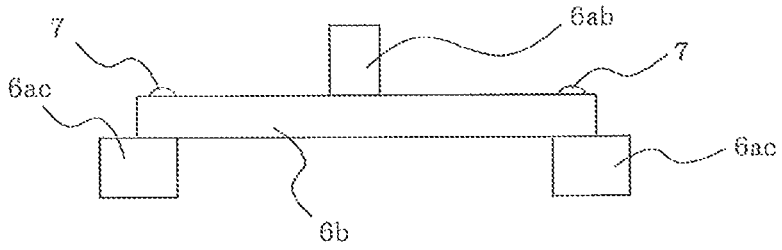
FIG. 5*b* is a side view of the Oldham ring of the scroll compressor according to Embodiment of the present invention.

FIG. 4*a* is a perspective view of the Oldham ring 6 of the scroll compressor 100 according to Embodiment of the present invention. FIG. 4*b* is an enlarged view of a projection 7 formed on the Oldham ring 6 of the scroll compressor 100 according to Embodiment of the present invention. FIG. 5*a* is a top view of the Oldham ring 6 of the scroll compressor 100 according to Embodiment of the present invention. FIG. 5*b* is a side view of the Oldham ring 6 of the scroll compressor 100 according to Embodiment of the present invention. FIGS. 4*a* and 4*b* are collectively referred to as FIG. 4 below; FIGS. 5*a* and 5*b* as FIG. 5.

The Oldham ring 6 will now be described in detail with reference to FIGS. 2 to 5.

As shown in FIG. 4, the Oldham ring 6 includes the ring base 6*b*, the first Oldham keys 6*ab*, the second Oldham keys 6*ac*, and the projections 7. The first Oldham keys 6*ab* and the projections 7 are formed on one surface of the ring base 6*b*. The second Oldham keys 6*ac* are formed on the other surface.

As shown in FIGS. 2 and 3, the first Oldham keys 6*ab* and second Oldham keys 6*ac* formed on the ring base 6*b* of the Oldham ring 6 slidably engage with the pair of the first Oldham keyways 4 formed on the orbiting-scroll base plate 2*b* of the orbiting scroll 2 and the pair of the second Oldham keyways 5 formed on the frame 20 so as to lie at aright angle to the first Oldham keyways 4, respectively.

The projections 7 of the Oldham ring 6 are hemispherical and formed integrally with the Oldham ring 6. As shown in FIG. 5, two projections 7 are formed within portions of the ring base 6*b* opposite to the respective second Oldham keys 6*ac* (portions indicated by horizontal lines in FIG. 5*a*) so as to be symmetrical with respect to the center of the Oldham ring 6. The projections 7 of the Oldham ring 6 and the orbiting-scroll-base-plate back surface 2*e* are spaced such that the adhesive wear of the first Oldham keys 6*ab* can be prevented in the first Oldham keyways 4 of the orbiting scroll 2.

Figure 6:
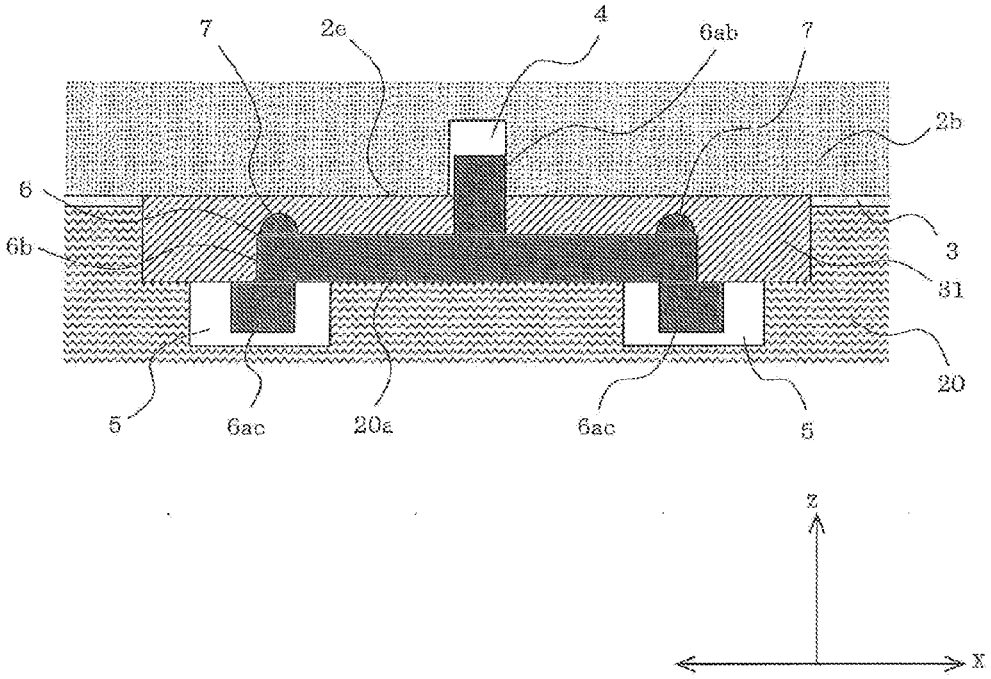
FIG. 6 is a first schematic diagram showing the Oldham ring of the scroll compressor according to Embodiment of the present invention when the wOldham ring is in simple harmonic motion.
Figure 7:
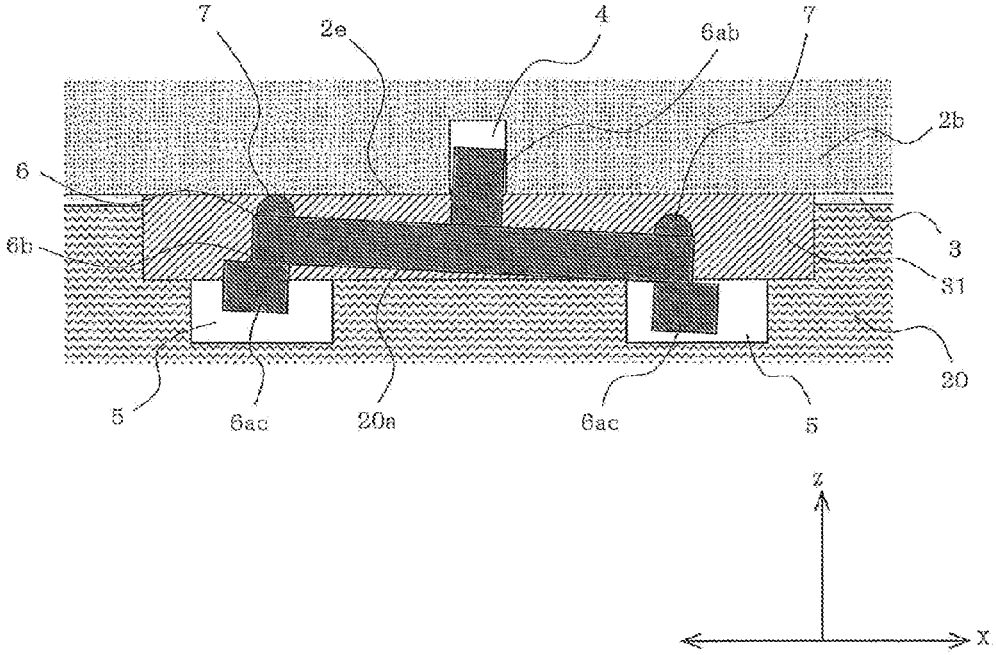
FIG. 7 is a second schematic diagram showing the Oldham ring of the scroll compressor according to Embodiment of the present invention when the Oldham ring is in simple harmonic motion.
Figure 8:
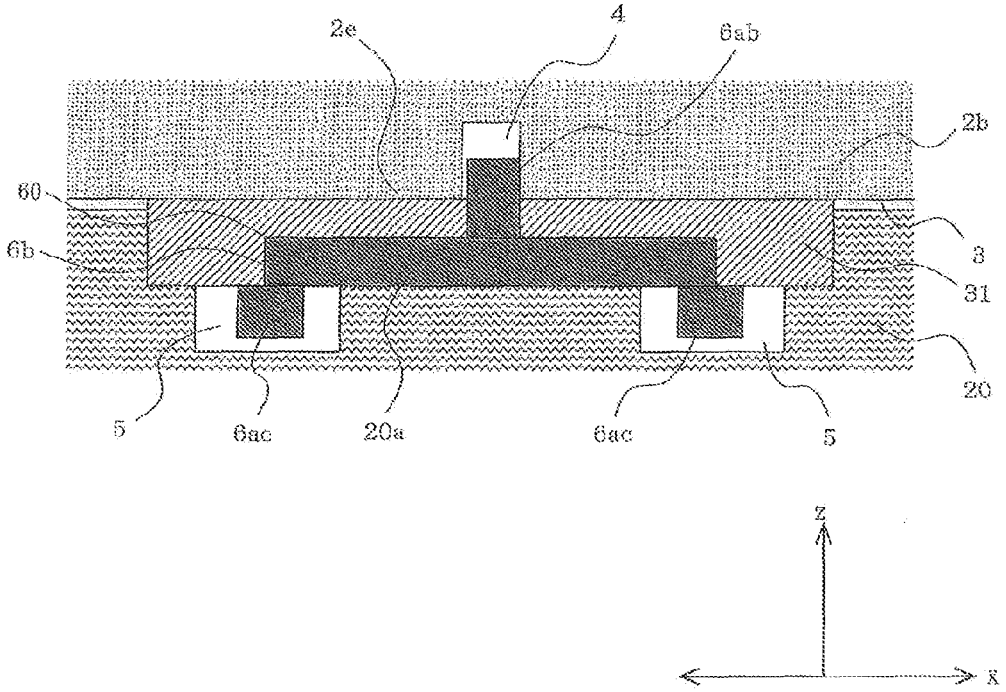
FIG. 8 is a first schematic diagram showing an Oldham ring of a conventional scroll compressor when the Oldham ring is in simple harmonic motion.
Figure 9:
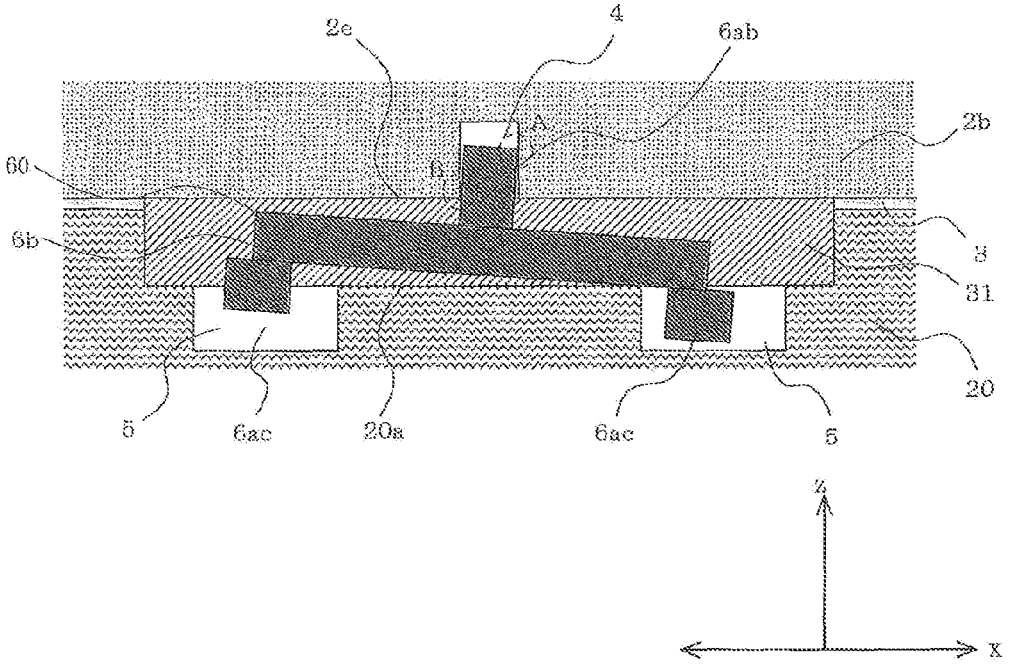
FIG. 9 is a second schematic diagram showing the Oldham ring of the conventional scroll compressor when the Oldham ring is in simple harmonic motion.

FIG. 6 is a first schematic diagram showing the Oldham ring 6 of the scroll compressor 100 according to Embodiment of the present invention when the Oldham ring 6 is in simple harmonic motion. FIG. 7 is a second schematic diagram showing the Oldham ring 6 of the scroll compressor 100 according to Embodiment of the present invention when the Oldham ring 6 is in simple harmonic motion. FIG. 8 is a first schematic diagram showing an Oldham ring 60 of a conventional scroll compressor when the Oldham ring 60 is in simple harmonic motion. FIG. 9 is a second schematic diagram showing the Oldham ring 60 of the conventional scroll compressor when the Oldham ring 60 is in simple harmonic motion.

The simple harmonic motion of the Oldham ring 6 during the operation of the scroll compressor will now be described with reference to FIGS. 6 to 9.

As shown in FIGS. 6 and 8, the simple harmonic motion of the Oldham rings 6 and 60 begins in the X-axis direction with the start of the operation of the scroll compressors. A space 31 in which the Oldham rings 6 and 60 undergo their simple harmonic motion is defined by the orbiting-scroll-base-plate back surface 2*e*, the thrust plate 3, and the frame 20 and indicated by oblique lines in FIGS. 6 to 9. This space 31 is filled with the lubricant supplied through the oil supplying passage 33.

When the inertial force of the Oldham rings 6 and 60 in simple harmonic motion is small, the Oldham rings 6 and 60 are seated on the Oldham-ring seating surface 20*a* of the frame 20 and undergo their simple harmonic motion in the X-axis direction along the second Oldham keyways 5 of the frame 20. During high-speed operation, however, the Oldham rings 6 and 60 begin to be inclined due to increased inertial force, as shown in FIGS. 7 and 9. For the conventional Oldham ring 60 having no projection 7 shown in FIG. 9, as the degree of the inclination increases, each of the first Oldham keys 6*ab* is brought into contact with the interior of the corresponding first Oldham keyway 4 at two locations (points A and B in FIG. 9). Thus, the adhesive wear of the first Oldham keys 6*ab* occurs inside the first Oldham keyways 4, resulting in galling.

In contrast, in the Oldham ring 6 having the projections 7 according to Embodiment as shown in FIG. 7, one of the projections 7 makes contact with the orbiting-scroll-base-plate back surface 2*e* before each of the first Oldham keys 6*ab* is brought into contact with the interior of the corresponding first Oldham keyway 4 at two locations (points A and B in FIG. 9). In this way, each of the first Oldham keys 6*ab* can be prevented from making contact with the interior of the corresponding first Oldham keyway 4 at two locations, and the occurrence of adhesive wear and galling can thereby be prevented.

Each of the projections 7 needs to have a sufficient height to make contact with the orbiting-scroll-base-plate back surface 2*e* before each of the first Oldham keys 6*ab* is brought into contact with the interior of the corresponding first Oldham keyway 4 at two locations (points A and B in FIG. 9). However, if the projections 7 have a sufficient height to make contact with the orbiting-scroll-base-plate back surface 2*e* when the Oldham ring 6 is not inclined, the Oldham ring 6 is held between the orbiting-scroll base plate 2*b* and the frame 20 and cannot move therebetween. The height of the projections 7 needs to be less than this height.

Reducing the size (height) of the projections 7 permits the suppression of a reduction in volume of the space 31 in which the Oldham ring 6 undergoes simple harmonic motion (volume of the Oldham ring 6 occupying the space 31). This enables the suppression of an increase in an oil churning loss due to the simple harmonic motion of the Oldham ring 6.

The projections 7 are preferably arranged at positions as close as possible to the outer periphery of the ring base 6*b* of the Oldham ring 6 (positions as far away as possible from the center of the Oldham ring 6). The reason is that the height of the projections 7 can be reduced, because for the same height, arranging the projections 7 on the outer periphery side more effectively enables inhibition of the inclination. This arrangement also enables an increase in tolerances for dimensions related to a space between the upper end of the projections 7 and the orbiting-scroll-base-plate back surface 2*e* (for example, the thickness of the thrust plate 3 and the height of the ring base 6*b* of the Oldham ring 6), permitting the required dimensional accuracy to be reduced.

Thus, the two projections 7 of the Oldham ring 6 are arranged within the portions of the ring base 6*b* opposite to the respective second Oldham keys 6*ac* so as to be symmetrical with respect to the center of the Oldham ring 6. This arrangement allows for prevention of the adhesive wear and galling of the first Oldham keys 6*ab*, which can be caused in the first Oldham keyways 4 of the orbiting scroll 2 by the Oldham ring 6 being inclined due to its increased inertial force when the scroll compressor 100 is operated at a high speed. In addition, the projections 7 are arranged at positions far away from the center of the Oldham ring 6 in the direction of simple harmonic motion of the Oldham ring 6 (X-axis direction), so that the size (height) of the projections 7 can be reduced. This enables the suppression of both a reduction in volume of the space 31 in which the Oldham ring 6 undergoes simple harmonic motion (volume of the Oldham ring 6 occupying the space 31) and an increase in the oil churning loss due to the simple harmonic motion of the Oldham ring 6.

Since the space between the upper end of the projections 7 and the orbiting-scroll-base-plate back surface 2*e* can also be increased, the tolerances for dimensions related to the space between the upper end of the projections 7 and the orbiting-scroll-base-plate back surface 2*e* (for example, the thickness of the thrust plate 3 and the height of the ring base 6*b* of the Oldham ring 6) can be increased, and required dimensional accuracy can be reduced. The hemispherical projections 7 can reduce losses due to sliding contact between the upper end of the projections 7 and the orbiting-scroll-base-plate back surface 2*e* when the adhesive wear of the first Oldham keys 6*ab* is prevented in the first Oldham keyways 4 of the orbiting scroll 2.

In Embodiment, the reason why the projections 7 are hemispherical is to reduce the losses due to the sliding contact by forming the surface in contact with the orbiting-scroll-base-plate back surface 2*e*, which is flat, into a spherical shape. The projections accordingly may have different shapes, provided that at least the contact surface (tip portion) is spherical. Although the Oldham ring 6 described by way of example includes projections 7 integrally formed therewith, the Oldham ring 6 may be configured such that the projections 7 are formed by pieces separate from the Oldham ring 6 and fixed to the Oldham ring 6 by fixing means such as bolting or press fitting, provided that the same effect can be achieved. The projections 7 of the Oldham ring 6 may be coated with, for example, resin to reduce the losses due to the sliding contact. Although the two projections 7 of the Oldham ring 6 are arranged so as to be symmetrical with respect to the center of the Oldham ring 6, this arrangement of the projections is not limited to being perfectly symmetrical, and one or more additional projections may be provided in addition to the two symmetrically arranged projections 7.

REFERENCE SIGNS LIST

1 stationary scroll 1*a* stationary-scroll wrap 1*b* stationary-scroll base plate 2 orbiting scroll 2*a* orbiting-scroll wrap 2*b* orbiting-scroll base plate 2*c* orbiting-scroll thrust bearing surface 2*d* boss 2*e* orbiting-scroll-base-plate back surface 3 thrust plate 4 first Oldham keyway (of the orbiting scroll) 5 second Oldham keyway (of the frame) 6 Oldham ring 6*ab* first Oldham key (that slidably engages with the Oldham keyway of the orbiting scroll) 6*ac* second Oldham key (that slidably engages with the Oldham keyway of the frame) 6*b* ring base (of the Oldham ring) 7 projection (of the Oldham ring) 8 center shell 9 main shaft 9*a* eccentric shaft 10 power terminal 11 stator 12 rotor 13 first balance weight 14 second balance weight 15 suction pipe 16 discharge outlet 17 discharge pipe 18 low-pressure chamber 19 high-pressure chamber 20 frame 20*a* Oldham-ring seating surface 21 main bearing 22 upper shell 23 lower shell 24 sealed container 25 compression chamber 26 seal 27 seal 28 discharge valve 29 sub frame 30 sub bearing 31 space in which the Oldham ring undergoes simple harmonic motion 32 oil pump 33 oil supplying passage 60 (conventional) Oldham ring 100 scroll compressor

The invention claimed is:

1. A scroll compressor comprising:

a stationary scroll;

an orbiting scroll having a pair of first Oldham keyways on one surface thereof, the orbiting scroll defining a compression chamber in combination with the stationary scroll;

a frame having a pair of second Oldham keyways and supporting the orbiting scroll; and an Oldham ring for inhibiting rotation of the orbiting scroll, the Oldham ring having a pair of first Oldham keys on one surface thereof and a pair of second Oldham keys on an other surface thereof, the first Oldham keys slidably engaging with the respective first Oldham keyways, the second Oldham keys slidably engaging with the respective second Oldham keyways, wherein the Oldham ring includes at least a pair of projections on the one surface thereof, and wherein the projections have a height such that when the Oldham ring is inclined during simple harmonic motion, one of the projections makes contact with the one surface of the orbiting scroll before each of the first Oldham keys is brought into contact with a corresponding first Oldham keyway of the first Oldham keyways at two locations.

2. The scroll compressor of claim 1, wherein the pair of projections are formed within portions of the Oldham ring opposite to the respective second Oldham keys.

3. The scroll compressor of claim 1, wherein the pair of projections are formed so as to be symmetrical with respect to a center of the Oldham ring.

4. The scroll compressor of claim 1, wherein each of the projections is formed on an outer peripheral side of the Oldham ring.

5. The scroll compressor of claim 1, wherein a surface of each of the projections that makes contact with the one surface of the orbiting scroll has a spherical shape.

6. The scroll compressor of claim 1, wherein each of the first Oldham keys has a quadrangular prism shape.

7. The scroll compressor of claim 1, wherein the projections are coated with resin.

8. The scroll compressor of claim 1, wherein the projections are formed integrally with the Oldham ring.

9. The scroll compressor of claim 1, wherein the projections are formed by pieces separate from the Oldham ring.

* * * * *